United States Patent [19]

Kwok

[11] 4,426,039

[45] Jan. 17, 1984

[54] SPRAY GUN CONTROL VALVE

[75] Inventor: Kui C. Kwok, Arden Hills, Minn.

[73] Assignee: Graco Inc., Minneapolis, Minn.

[21] Appl. No.: 338,424

[22] Filed: Jan. 11, 1982

[51] Int. Cl.[3] ..... B05B 7/12

[52] U.S. Cl. ..... 239/415; 239/528

[58] Field of Search ..... 239/415, 527, 528; 137/630.19

[56] References Cited

U.S. PATENT DOCUMENTS

| | | | |
|---|---|---|---|
| 1,682,037 | 8/1928 | Craig | 239/528 |
| 1,751,608 | 3/1930 | Tittemore et al. | 239/528 |
| 1,797,209 | 3/1931 | Bramsen et al. | 239/528 |
| 1,940,268 | 12/1933 | Peterson | 239/528 |
| 2,149,932 | 3/1939 | Zippel | 239/527 |
| 3,796,376 | 3/1974 | Farnsteiner | 239/528 |

FOREIGN PATENT DOCUMENTS

| | | | |
|---|---|---|---|
| 102910 | 1/1917 | United Kingdom | 239/415 |

*Primary Examiner*—John J. Love
*Assistant Examiner*—Michael J. Forman
*Attorney, Agent, or Firm*—Paul L. Sjoquist

[57] ABSTRACT

A control valve for a spray gun which is engageable by a spray gun trigger to release pressurized air and pressurized liquid through the spray gun for spraying in a predetermined sequence. The valve includes a slidable spool axially aligned with a liquid valve and valve seat and connected thereto by an axial valve stem, whereby the slidable spool has a beveled surface thereon, which surface is in contact with a second valve stem aligned in an air passage in the handle of the spray gun for opening and closing an air valve therein. The valve mechanism is actuated by trigger movement, first to open the air valve and second to open the liquid valve to insure the controlled release of pressurized liquid and air for optimum spraying conditions.

12 Claims, 2 Drawing Figures

SPRAY GUN CONTROL VALVE

BACKGROUND OF THE INVENTION

The present invention relates to spray guns, and more particularly to spray guns for the spraying of paint in an atomized and well controlled pattern for quality finishing of products. The spray gun is particularly adapted to paint spraying wherein paint is delivered to the gun under pressure and wherein a separate source of pressurized air is also coupled to the gun. This type of spraying is commonly refered to as air/airless paint spraying, which offers the particular advantage of providing a quality spray finish under nominal paint and air pressure conditions.

In the art of paint spraying it has long been known that quality spray finishes can be obtained by the controlled application of pressurized air to both atomize the paint and control the direction and shaping of the atomized pattern of paint. Likewise, it has been known that spray finishing can be accomplished by hydraulically pressurizing the paint to high pressures, in the order of 1,000–3,000 pounds per square inch (PSI), and ejecting this pressurized paint through a very small spray orifice for atomization. In all cases, such spray guns have commonly utilized trigger mechanisms mechanically coupled to valves for unseating the valve and releasing air or paint for spraying. In some cases, high pressure paint valves have been operable through the use of an air assist piston, whereby a source of pressurized air is coupled to the gun for the primary purpose of actuating a miniature air piston/cylinder to assist in unseating a liquid flow valve and thereby require less finger pressure to actuate the trigger. Air assist valves have typically been utilized in spray guns where high hydraulic pressures have been developed for spraying in the paint, for such paint control valves require unusually large spring forces for seating the valves to prevent leakage. These seating forces must be overcome when the valve is opened and air cylinders have been found useful for this purpose.

In a paint spray gun utilized for air/airless paint spraying there is a need for the proper control of two valves. One of these valves is a paint liquid sealing valve and the other valve is an air release valve to permit the proper and timely introduction of pressurized air to the painting process. It has been found preferable, when actuating air/airless spray guns, to first release the pressurized air, slightly ahead of the release of pressurized paint at the time the spray operation is started. Likewise, when spray operation is finished it is preferable to first disconnect the flow of pressurized paint and second disconnect the pressurized air supply. This procedure for opening and closing the respective valves has been found to provide the best overall spray painting operation under air/airless painting conditions.

SUMMARY OF THE INVENTION

Briefly, the invention comprises a control valve assembly for use in spray guns of the type adapted for spraying liquids under hydrostatic pressures and for influencing and improving the quality of spray with pressurized air. The air valve assembly includes an air passage through the handle of the spray gun and further passages directing the air therefrom to predetermined air jets in the gun nozzle, and a liquid valve actuator operable by a trigger. The liquid valve actuator is axially aligned with the liquid spray valve in the nozzle of the gun, and is coupled to an air valve in the handle of the gun by means of a slidable spool having a beveled surface portion engageable against an actuating stem of the air valve. The engagement of the gun trigger first causes actuation of the air valve and, after a predetermined degree of trigger motion, causes actuation of the liquid valve. Upon disengagement of the trigger the liquid valve is closed at a first trigger position and the air valve is closed at a second and later trigger position, thereby permitting the flow of pressurized air to continue after liquid discharge from the gun ceases.

BRIEF DESCRIPTION OF THE DRAWINGS

A detailed understanding of the operation and construction of the invention will become apparent from the following specification and claims, and with reference to the appended drawings, in which:

DESCRIPTION OF THE PREFERRED EMBODIMENT

Figure 1:
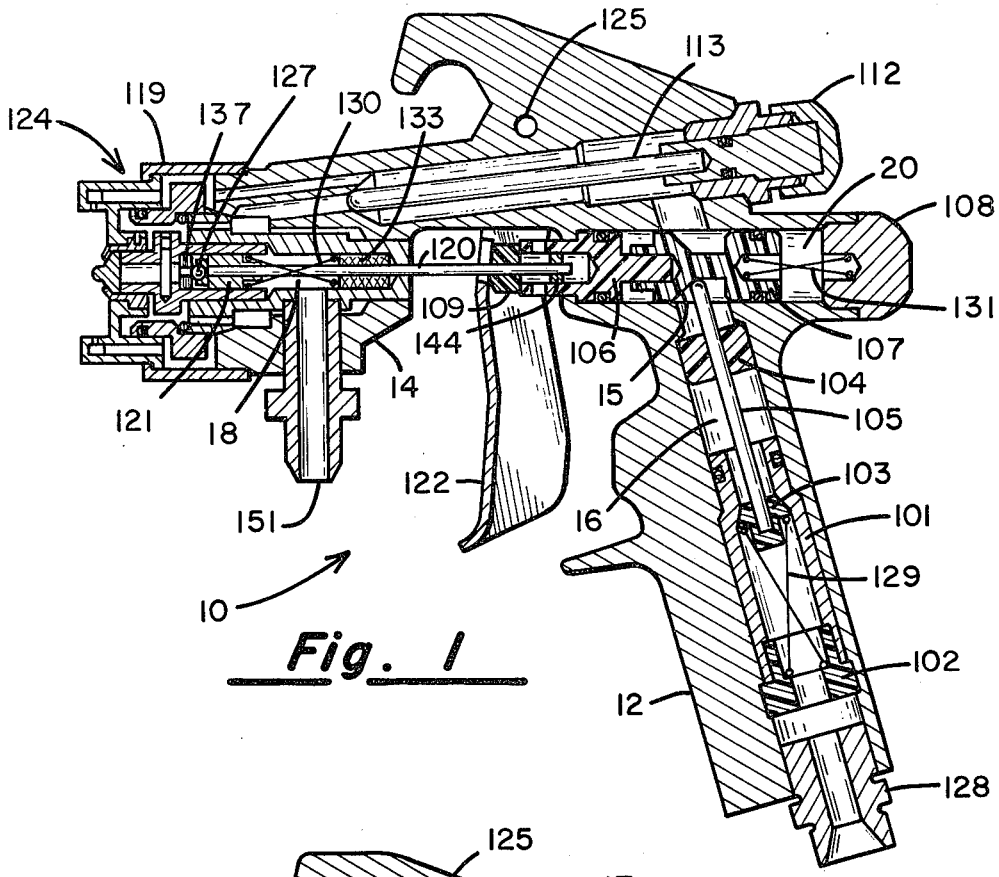
FIG. 1 shows the spray gun in elevation and cross sectional view in a deactuated trigger position.

Referring first to FIG. 1, spray gun 10 is shown in elevational and cross-sectional view. The body of spray gun 10 is formed generally into a handle 12 and a barrel 14. A nozzle assembly 124 is threadable secured to the front end of barrel 14 by means of a locknut 119. The spray gun trigger 122 is pivotally connected to the body of the spray gun 10 by means of a pin 125, and trigger 122 is shown in its disengaged position in FIG. 1. The construction and operation of nozzle 124 is more particularly described in co-pending United States patent application Ser. No. 332,089, filed Dec. 18, 1981. A liquid inlet 151 is attached into barrel 14, and an air connector 128 is coupled into handle 12 and is adapted for coupling to a source of pressurized air. Similarly, liquid inlet 151 is adapted for coupling to a source of pressurized liquid, preferable paint.

Trigger 122 is engageable against a spacer 109. Spacer 109 abuts against the front end of a slidable housing 106. Housing 106 has a forwardly facing cavity which accepts liquid valve stem 120, and a locknut 144 threaded or otherwise secured to the end of valve stem 120. Locknut 144 is slidable within the forward cavity of housing 106. Housing 106 is coupled to an air actuator 107 and is slidable therewith. Suitable O-rings about housing 106 and actuator 107 provide an air seal for preventing the escape of pressurized air from within spray gun 10. Air actuator 107 has a tapered or beveled surface 15, which surface is engageable against a valve stem 105. Valve stem 105 is connected to a poppet valve 103 positioned inside an air valve sleeve 101. A stem guide 104 supports valve stem 105 within a passage 16 in spray gun handle 12. Stem guide 104 is ported to provide air passages to permit the free flow of pressurized air through the interior of handle 12 to nozzle assembly 124. Air valve sleeve 101 is secured within passage 16 by means of a threaded retainer 102. Retainer 102 may be threaded in passage 16 to securely hold sleeve 101 against a shoulder formed within passage 16. A spring 129 is compressed between retainer 102 and poppet valve 103, and serves to urge poppet valve 103 against a valve seat formed on air valve sleeve 101.

Liquid valve stem 120 is connected to a ball valve retainer 121 which is slidable within passage 18. Ball valve retainer 121 has affixed at its forward end a ball valve 127. Ball valve 127 may be seated against a valve seat 137. A spring 130 is compressed between a packing 133 and ball valve retainer 121, and urges ball valve retainer 121 forwardly to close valve 127 against seat 137.

A further manually adjustable valve 112 is included in the spray gun in which the present invention is embodied, but does not form a part of the present invention. Valve 112 is rotatably adjustable, to open and close valve stem 113 against a seat for the selective regulation of air flow therethrough for purposes outside the scope of the present invention.

Air actuator 107 is slidably enclosed within passage 20, and a removable valve cap 108 is threadably secured to close passage 20. A spring 131 is compressed between valve cap 108 and air actuator 107, to urge air actuator 107 in a forward direction.

Figure 2:
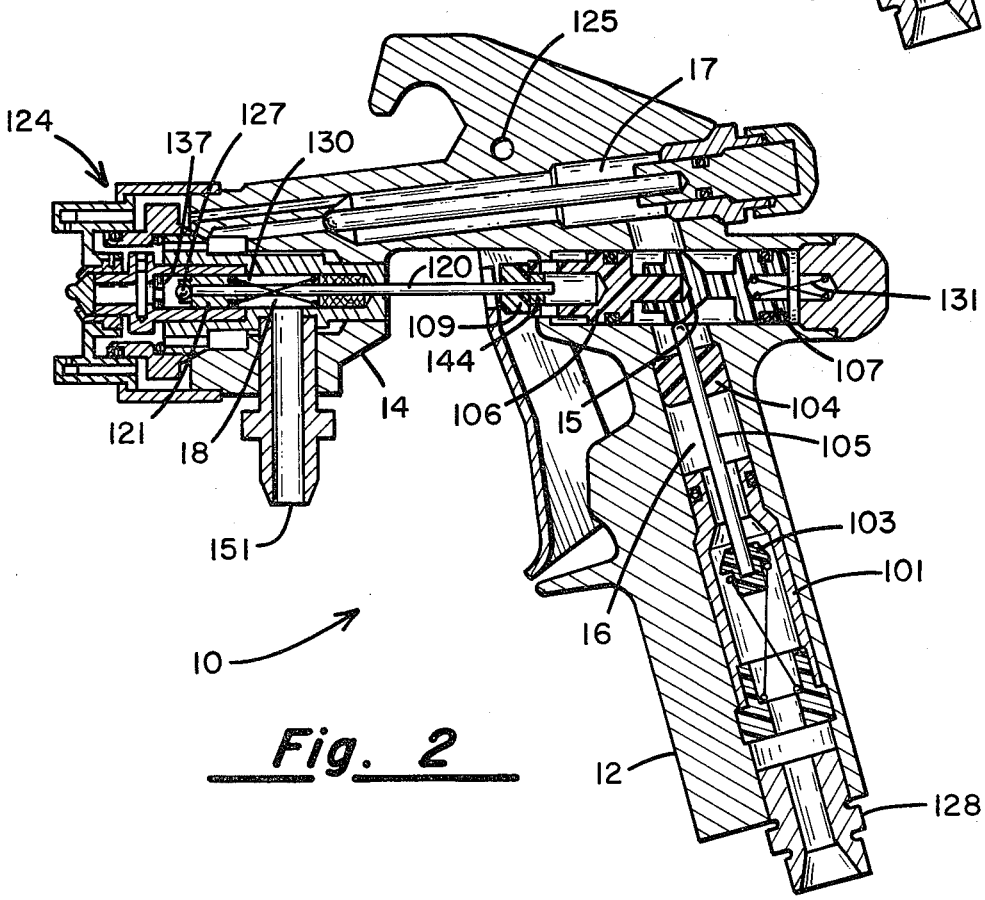
FIG. 2 shows the spray gun in an elevational and cross sectional view in a fully actuated trigger position.

FIG. 2 shows spray gun 10 in elevational and cross sectional view, with trigger 122 fully engaged. Trigger 122 contacts spacer 109, which abuts against the forward end of slidable housing 106 and moves it rearwardly. Spacer 109 also contacts and moves rearwardly locknut 144 which is attached to liquid valve stem 120. Liquid valve stem 120 is connected to ball valve retainer 121 and causes it to slide rearwardly in passage 18. Ball valve 127 thereby unseats from seat 137 and provides a liquid flow path from inlet 151 to nozzle 124. The rearward motion of housing 106 is mechanically coupled to air actuator 107, thereby causing it to move rearwardly. Valve stem 105 slides along tapered surface 15 and is urged downwardly. Valve stem 105 is coupled to poppet valve 103, causing poppet valve 103 to unseat and thereby permitting compressed air to flow from inlet 128 into passage 16. The flow of compressed air is permitted to flow into passage 17 and into nozzle 124.

In operation, it should be noted that air valve stem 105 is continuously engaged against tapered surface 15, and therefore immediately responds to any rearward motion of actuator 107. As the trigger 122 is initially engaged, air actuator 107 immediately begins sliding rearwardly and valve stem 105 immediately moves downwardly. This causes poppet valve 103 to unseat correspondingly, and immediately permits the flow of pressurized air through the spray gun. As trigger 122 is further actuated the flow of pressurized air continues until the trigger is actuated to cause spacer 109 to come into contact with locknut 144 on liquid valve stem 120. At this point of actuation of trigger 122, valve stem 120 is caused to move rearwardly, thereby unseating liquid ball valve 127 from seat 137. This permits the flow of pressurized liquid from inlet 151 into nozzle 124 and permits spraying with the spray gun.

As trigger 122 is disengaged liquid valve stem 120 moves forwardly until locknut 144 becomes released from contact against spacer 109, and valve 127 is again seated against seat 137. This causes the flow of liquid through nozzle 124 to cease. As the trigger is further released, air actuator 107 continues to slide forwardly and valve stem 105 slides along beveled surface 15. When valve stem 105 reaches the inside diameter of beveled surface 15 poppet valve 103 again becomes seated inside air valve sleeve 101 and the flow of air through the spray gun is shut off.

In the manner hereinbefore described, the actuation of the spray gun trigger will always result in the first actuation of air through the spray gun, followed by release of liquid for spraying. Upon disengagement of the trigger the sprayed liquid will first be shut off while air flow through the spray gun continues, and air flow will be shut off when the trigger is completely disengaged.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A liquid spray gun of the type having a barrel, handle and trigger, and including a control valve engageable by the trigger for selectively controlling the release of pressurized liquid through the spray gun barrel for spraying and the release of pressurized air through the spray gun barrel and handle for affecting the sprayed liquid, comprising (a) an air passage along a first axis through the handle of said spray gun, said passage being adapted for coupling to a source of pressurized air at one end of said handle;

(b) an air valve in said passage, said air valve having an air actuating stem extending along said first axis away from said one end of said handle;

(c) a liquid valve and chamber in said barrel in liquid flow coupling relationship, said chamber being adapted for coupling to a source of pressurized liquid, and said valve having a liquid actuating stem extending along a second axis which intersects the first axis;

(d) a further passage in said handle, said further passage being concentric to said second axis;

(e) a slidable spool in said further passage, said spool having a beveled surface portion engageable against said air actuating stem to cause movement of said air actuating stem and said air valve along said first axis upon predetermined first movement of said spool along said second axis; said spool further having a shoulder engageable by said trigger and a recess for receiving said liquid actuating stem;

(f) first spring biasing means in said further passage for urging said spool toward said liquid actuating stem;

(g) second spring biasing means in said chamber for urging said liquid valve away from said slidable spool;

(h) a mechanical stop attached to said liquid actuating stem and slidingly retained in said spool recess, said mechanical stop being engageable by said spool upon second predetermined movement of said spool along said second axis to cause movement of said liquid actuating stem and said liquid valve along said second axis, said second predetermined movement being greater than said predetermined first movement; whereby continuous movement of said trigger first causes said air valve to open and second causes said liquid valve to open.

2. The apparatus of claim 1 wherein said slidable spool further comprises a cylindrical end portion engageable by said trigger, said cylindrical end portion having said recess for receiving said liquid actuating stem.

3. The apparatus of claim 2, wherein said mechanical stop further comprises an end cap sized for slidable fitting into said cylindrical end portion recess.

4. The apparatus of claim 1, wherein said beveled surface on said slidable spool further comprises a frusto-conical surface.

5. The apparatus of claim 4, wherein said air valve further comprises a frusto-conical valve member and seat member, said members being in sealing engagement when said air valve actuating stem is engageable against a smaller diameter of said spool frusto-conical surface, and said members being in sealing disengagement when said air valve actuating stem is engageable against all other portions of said frusto-conical spool surface.

6. In a spray gun of the type having a general pistol shape with a liquid inlet into a barrel and an air inlet into a handle, and where the barrel lies along an axis and the handle lies along an axis approximately mutually perpendicular and intersecting to the axis of the barrel, the improvement comprising (a) a first passage through the spray gun parallel to said barrel axis and intersecting said liquid inlet;
(b) a second passage in the handle of said spray gun parallel to said handle axis and intersecting said first passage, and communicating with said air inlet;
(c) a liquid valve in said first passage having a liquid actuating stem extending along said first passage toward said handle;
(d) an air valve in said second passage having an air actuating stem extending along said second passage toward the intersection of said barrel axis and said handle axis;
(e) a spool slidable in said first passage, said spool having a recess for accepting said liquid actuating stem and having a tapered portion engageable against said air actuating stem
(f) a mechanical stop attached to said liquid actuating stem in said recess;
(g) a first compression spring in said first passage urging said spool toward said liquid valve;
(h) a second compression spring in said first passage urging said liquid valve away from said spool;
(i) a trigger pivotally attached to said barrel, said trigger being firstly engageable against said slidable spool to cause movement of said spool along said barrel axis and consequent movement of said air actuating stem along said handle axis, said trigger being secondly engageable against said mechanical stop to cause movement of said liquid actuating stem along said barrel axis.

7. The improvement of claim 6 wherein said spool tapered portion further comprises a frusto-conical surface.

8. The improvement of claim 9, wherein said first passage has two segments, a first segment in said barrel and a second segment in said handle.

9. The improvement of claim 8, wherein said trigger is pivotally movable in the space between said first and second segments of said first passage.

10. The improvement of claim 9, wherein said liquid valve actuating stem extends through an opening in said trigger into said second segment.

11. The improvement of claim 10, wherein said slidable spool is located in said second segment of said first passage.

12. The improvement of claim 11, wherein said slidable spool has an end projecting outside of said second segment and engageable by said trigger.

* * * * *